US007442011B2

(12) United States Patent
Negulescu et al.

(10) Patent No.: US 7,442,011 B2
(45) Date of Patent: Oct. 28, 2008

(54) LOCKING DEVICE FOR TURBINE BLADES

(75) Inventors: Joana Negulescu, Berlin (DE); Peter Davison, Wünsdorf (DE)

(73) Assignee: Rolls-Royce Deutschland Ltd & Co KG, Blankenfelde-Mahlow (DE)

( * ) Notice: Subject to any disclaimer, the term of this patent is extended or adjusted under 35 U.S.C. 154(b) by 255 days.

(21) Appl. No.: 11/100,404

(22) Filed: Apr. 7, 2005

(65) Prior Publication Data

US 2005/0226729 A1 Oct. 13, 2005

(30) Foreign Application Priority Data

Apr. 7, 2004 (DE) ..... 10 2004 017 193

(51) Int. Cl.
*F01D 5/32* (2006.01)

(52) U.S. Cl. ..... 416/221; 29/889.21

(58) Field of Classification Search ..... 416/219 R, 416/220 R, 221; 29/889.21, 889.22
See application file for complete search history.

(56) References Cited

U.S. PATENT DOCUMENTS 2,846,183 A * 8/1958 Morgan ..... 416/221
2,912,223 A 11/1959 Hull
3,986,779 A * 10/1976 Beckershoff ..... 416/221
4,820,127 A * 4/1989 Cohen et al. ..... 416/221
5,720,596 A 2/1998 Pepperman

FOREIGN PATENT DOCUMENTS

| | | |
|---|---|---|
| DE | 1090231 | 3/1961 |
| DE | 1159964 | 7/1964 |
| DE | 2433043 | 12/1975 |
| GB | 980656 | 1/1965 |

* cited by examiner

*Primary Examiner*—Richard A. Edgar
(74) *Attorney, Agent, or Firm*—Timothy J. Klima

(57) ABSTRACT

A turbine blade locking device axially retains a turbine blade (1) inserted in an axial, profiled slot (10) of a turbine disk (6). The turbine disk (6) is provided with a locking groove (8) passing through the slot (10) and extending radially in the plane of the turbine disk (6). A locking pin (4) is inserted in the locking groove (8) and the blade root (3) is provided at its bottom side with a notch (9) aligning with the locking groove (8). A portion of an elastic element (5) is arranged radially below the locking pin (4) to pre-load the locking pin (4) in a radially outward direction and into the notch (9).

20 Claims, 2 Drawing Sheets

LOCKING DEVICE FOR TURBINE BLADES

This application claims priority to German Patent Application DE 102004017193.9 filed Apr. 7, 2004, the entirety of which is incorporated by reference herein.

BACKGROUND OF THE INVENTION

This invention relates to a turbine blade locking device for axial retention of a turbine blade on the turbine disk.

In the state of the art, it is known to provide the blade roots of turbine blades with a profile to take up the radially directed forces occurring during the operation of a gas turbine.

In order to prevent the blade root from moving axially relative to the turbine disk, a means of retention is required. Such means of retention are shown in Specifications EP 0 610 668 B1, U.S. Pat. No. 5,135,354 or U.S. Pat. No. 5,518,369 by way of example.

In the designs known from the state of art, plate-type elements are usually fitted which, together with abutments on the blade roots or the turbine disks, provide for axial retention. Disadvantageous here are the high assembly effort and the risk that these fixations may work loose or be inaccurately fitted, resulting in at least a slight axial displacement of the blade root relative to the turbine disk.

More particularly, cover plates, locking rings or locking plates, or a combination thereof, are used in the state of the art, which must be deformed, for example bent, during assembly.

A further disadvantage is the higher mass of the total design and the considerable manufacturing and assembly costs.

Another disadvantage lies in the fact that serviceability and reliability are not always ensured or that relatively expensive inspection activities are required to check for correctness of assembly.

BRIEF SUMMARY OF THE INVENTION

A broad aspect of the present invention is to provide a turbine blade locking device of the type specified above which, while being characterized by simple design, easy and cost-effective manufacture and easy assembly, provides for a high degree of reliability and safety.

It is a particular object of the present invention to provide solution to the above problems by a combination of the features described below. Further advantageous embodiments of the present invention will be apparent from the description herein.

In accordance with the present invention, a locking groove is, therefore, provided in the turbine disk which passes through the slot for fitting the blade root and which extends radially in the plane of the turbine disk. Inserted in the locking groove is a locking pin which, accordingly, extends in essentially the circumferential direction of the turbine disk. Due to the locking groove, the locking pin is radially displaceable. At the bottom side of the blade root, a notch or groove is provided into which the locking pin can be fitted at least partly (with regard to its length or its diameter, respectively). For fitting the locking pin in the notch of the blade root upon installation of the turbine blade, an elastic element is provided which is arranged beneath the locking pin and exerts a radially outward preload on the locking pin.

During the operation of the gas turbine, the centrifugal forces effect an outward preload or movement of the locking pin, as a result of which the locking pin is safely positioned in the notch or groove on the bottom side of the blade root. Thus, the blade root is accurately positioned relative to the turbine disk during operation. Axial positioning is here effected in both axial directions. In this respect, the present invention differs from the state of the art in which movement in one axial direction is frequently prevented by abutments, protrusions or similar features, while movement in the other axial direction is avoided by the above mentioned additional locking elements (plates etc.).

According to the present invention, the forces are introduced in an axial direction from the blade root via the locking pin into the turbine disk. This provides for a safe transfer of forces.

Accordingly, the present invention is advantageous in that life and reliability of the gas turbine are quite significantly increased. In addition, the present invention provides for ease of assembly without additional critical components. Furthermore, safety of assembly can be inspected by simple means. Additional cover plates or retention elements are not required.

Altogether, the present invention provides for a reduction of turbine mass and, thus, the costs of manufacture of the gas turbine.

The locking groove according to the present invention is preferably rectangular. Furthermore, it is favorable to provide the locking pin with a cylindrical cross-section insertable in a round cross-section of the notch on the blade root. For safe load transfer, it is advantageous if the end areas of the locking pin are given an essentially rectangular cross-section or are plane-milled.

The elastic element according to the present invention can be provided in the form of a spring which, upon insertion of the blade root into a corresponding slot of the turbine disk, is pushed under the locking pin to force the locking pin upwards.

BRIEF DESCRIPTION OF THE DRAWINGS

In the following, an embodiment of the present invention is described in light of the accompanying drawings. In the drawings.

DETAILED DESCRIPTION OF THE INVENTION

Figure 1:
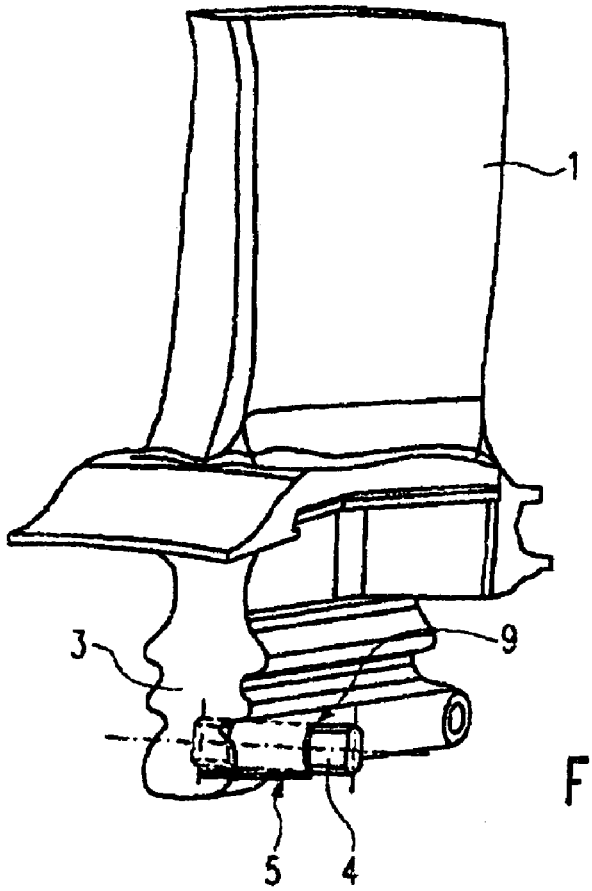
FIG. 1 is a simplified isometric view of a turbine blade with blade root according to the present invention.

FIG. 1 shows a turbine blade 1 which forms one part with a blade root 3. This blade root is provided with a fir tree-style profile, as known from the state of the art.

On the bottom end area of the blade root 3, a transverse notch 9 is provided which can have a semi-circular cross-section conformal with a cylindrical cross-section of a locking pin 4. As shown, the locking pin 4 has a cylindrical center section and generally rectangular end sections. In an alternative embodiment, the locking pin can have an alternative configuration. For example, the entire length of the locking pin 4 can be generally rectangular in cross-section, and not just the end portions. Other configurations can also be used and the configuration of the transverse notch 9 set accordingly to receive the locking pin 4 in an axially movement prohibiting manner.

FIG. 1 further shows an elastic element 5 in the form of a blade spring which serves to insert the locking pin 4 into the notch or groove 9, as described below.

Figure 2:
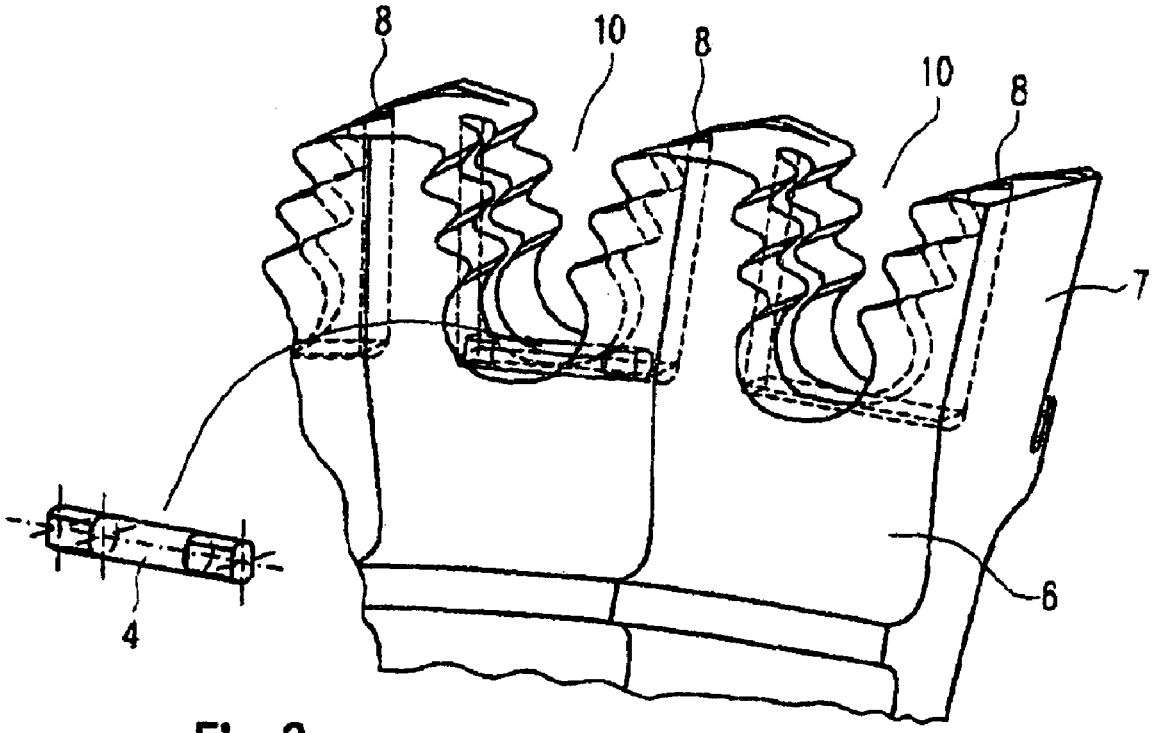
FIG. 2 is a simplified isometric partial view of a turbine disk with locking groove and associated locking pin.

FIG. 2 shows the associated area of a turbine disk 6. It features several, profiled slots 10, extending in the axial direction, each formed by lateral disk lobes 7. In a radial direction and in the plane of the turbine disk 6, a locking groove 8 is provided in each case into which the locking pin 4 can be inserted, as shown in FIG. 2. For clarity, the elastic element 5 is not illustrated in FIG. 2.

Figure 3:
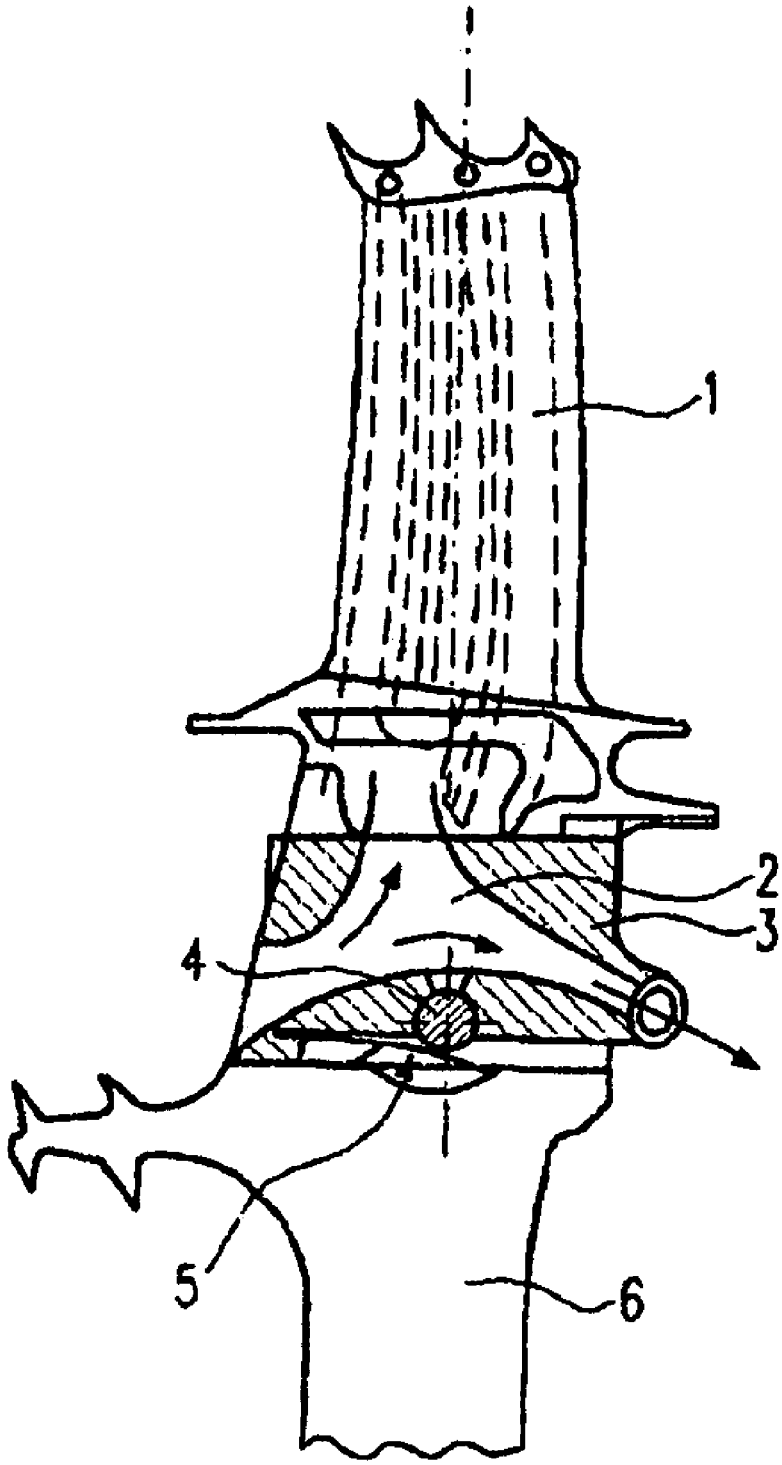
FIG. 3 is a schematic sectional view in the assembled state.

FIG. 3 shows a schematic partial sectional view in the assembled state. As can be seen, the locking pin 4 rests, with a major part of its cross-section, in the notch or groove 9. Furthermore, the illustration shows that the blade root 3 can be provided, in the usual manner, with at least one cooling duct 2. The design of the cooling duct 2 is not affected by the locking device according to the present invention.

FIG. 3 also shows the elastic element 5 for radial preloading of the locking pin 4.

For assembly, the locking pins 4 are inserted into the corresponding locking grooves 8. It is here a matter of definition whether two lateral locking grooves 8 are provided at each slot 10 or whether a single locking groove 8 corresponding to the length of the locking pin 4 is provided. The present invention relates to both such design or definition variants. Upon being inserted, the locking pin 4 sits at the bottom of the locking groove 8, enabling the blade root 3 to be fitted into the slot 10 of the turbine disk 6. Subsequently, the elastic element 5, in the form of a blade or leaf spring, is inserted together with the blade 1 (with one end of the elastic element 5 being attached to the blade root 3) such that a free end of the elastic element 5 is positioned under the locking pin 4 and exerts a radially outward force on the locking pin 4. As a result of this, the locking pin 4 is pushed radially outwards into the notch or groove 9 of the blade root 3. In an alternative embodiment, the elastic element 5 can be of a different configuration. It can also be positioned under the locking pin 4 and need not be fixedly attached to the blade 1.

For disassembly or removal of the turbine blade, a tool or fixture is radially inwardly inserted into the locking groove(s) 8 to contact and move the locking pin 4 radially inward and out of notch 9 of the blade root 3, thus enabling the latter to be removed in an axial direction.

LIST OF REFERENCE NUMERALS

1 Turbine blade
2 Cooling duct
3 Blade root
4 Locking pin
5 Elastic element
6 Turbine disk
7 Disk lobe
8 Locking groove
9 Notch
10 Axial slot on disk assembly

What is claimed is:

1. A turbine blade locking device for axial retention of a turbine blade inserted in an axial, profiled slot of a turbine disk, comprising:

a locking groove positioned in the turbine disk that passes through the slot and extends radially in a plane of the turbine disk, a locking pin inserted in the locking groove, the locking groove engaging the locking pin to circumferentially position the locking pin with respect to the axial, profiled slot of the turbine disk, a notch provided on a bottom side of a root of the blade, the notch aligning with the locking groove, and an elastic element having a portion arranged radially below the locking pin to pre-load the locking pin in a radially outward direction and into the notch.

2. A device in accordance with claim 1, wherein the locking groove has a generally rectangular shape.

3. A device in accordance with claim 2, wherein the locking pin has a cylindrical cross-section.

4. A device in accordance with claim 3, wherein end portions of the locking pin have a generally rectangular cross-section and a center portion of the locking pin has the cylindrical cross-section.

5. A device in accordance with claim 4, wherein the elastic element is a blade spring.

6. A device in accordance with claim 5, wherein one end of the blade spring is attached to the root of the blade and a free end is positioned under the locking pin.

7. A device in accordance with claim 1, wherein the locking pin has a cylindrical cross-section.

8. A device in accordance with claim 1, wherein end portions of the locking pin have a generally rectangular cross-section and a center portion of the locking pin has a cylindrical cross-section.

9. A device in accordance with claim 1, wherein the elastic element is a blade spring.

10. A device in accordance with claim 9, wherein one end of the blade spring is attached to the root of the blade and a free end is positioned under the locking pin.

11. A device in accordance with claim 1, wherein the notch has a cross-section similar to a cross-section of the portion of the locking pin that it receives.

12. A turbine blade locking device for axial retention of a turbine blade inserted in an axial, profiled slot of a turbine disk, comprising:

a locking groove positioned in the turbine disk that passes through the slot and extends radially in a plane of the turbine disk, a locking pin inserted in the locking groove, a notch provided on a bottom side of a root of the blade, the notch aligning with the locking groove, and an elastic element having a portion arranged radially below the locking pin to pre-load the locking pin in a radially outward direction and into the notch, wherein one end of the blade spring is attached to the root of the blade and a free end is positioned under the locking pin.

13. A device in accordance with claim 12, wherein the locking groove has a generally rectangular shape.

14. A device in accordance with claim 13, wherein the locking pin has a cylindrical cross-section.

15. A device in accordance with claim 14, wherein end portions of the locking pin have a generally rectangular cross-section and a center portion of the locking pin has the cylindrical cross-section.

16. A device in accordance with claim 15, wherein the elastic element is a blade spring.

17. A device in accordance with claim 12, wherein the locking pin has a cylindrical cross-section.

18. A device in accordance with claim 12, wherein end portions of the locking pin have a generally rectangular cross-section and a center portion of the locking pin has a cylindrical cross-section.

19. A device in accordance with claim 12, wherein the elastic element is a blade spring.

20. A device in accordance with claim 12, wherein the notch has a cross-section similar to a cross-section of the portion of the locking pin that it receives.

* * * * *